United States Patent [19]

Uehara et al.

[11] 4,244,678

[45] Jan. 13, 1981

[54] DISPLACEMENT CONTROL SYSTEM FOR VARIABLE DISPLACEMENT PUMP

[75] Inventors: Kazuo Uehara, Tokyo; Hideaki Toma, Yokohama; Yoshito Sato, Hirakata, all of Japan

[73] Assignee: Kabushiki Kaisha Komatsu Seisakusho, Tokyo, Japan

[21] Appl. No.: 52,098

[22] Filed: Jun. 26, 1979

[30] Foreign Application Priority Data

Jun. 26, 1978 [JP] Japan ..... 53-86675

[51] Int. Cl.[3] ..... F04B 49/00

[52] U.S. Cl. ..... 417/218

[58] Field of Search ..... 417/218, 222, 213, 216; 60/444, 445, 447, 449, 452; 91/506, 508

[56] References Cited

U.S. PATENT DOCUMENTS

| | | | |
|---|---|---|---|
| 3,797,245 | 3/1974 | Hein | 60/452 |
| 3,830,594 | 8/1974 | Hein et al. | 417/217 |
| 3,935,706 | 2/1976 | Stevens | 60/444 |
| 3,949,649 | 4/1976 | Bosch | 91/506 |
| 4,067,664 | 1/1978 | Robeller | 417/218 |
| 4,158,529 | 6/1979 | Nonnemacher et al. | 417/216 |

*Primary Examiner*—Leonard D. Christian
*Attorney, Agent, or Firm*—Armstrong, Nikaido, Marmelstein & Kubovcik

[57] ABSTRACT

A displacement control system for a variable displacement pump comprising a charge pump; a first and a second actuators connected in parallel to the variable displacement pump; a cut-off control valve connected to the charge pump, the cut-off control valve including a valve body having a first and a second pump ports, a pressure port and an outlet port formed therein, the first pump port being connected to the charge pump, the second pump port being connected to the variable displacement pump and the pressure port being connected to the first actuator, a sleeve mounted within the valve body, a first and a second pins slidably mounted within the sleeve, a spool slidably mounted within the sleeve, a cylindrical cap member fixedly secured to the valve body defining a spring chamber therein, and a spring disposed within the spring chamber for urging the spool toward connecting the first pump port with the outlet port; and a servo booster connected to the outlet port for controlling the displacement of the variable displacement pump.

4 Claims, 4 Drawing Figures

DISPLACEMENT CONTROL SYSTEM FOR VARIABLE DISPLACEMENT PUMP

BACKGROUND OF THE INVENTION

This invention relates to a cut-off control system for variable displacement pumps and more particularly to a control system for preventing the generation of excessive pressure by reducing the displacement volume of such pumps.

In conventional control systems of the type specified, the arrangement is made such that when the delivery pressure of the pump has become more than a predetermined cut-off pressure set by a spring of a cut-off control valve, the spool thereof is urged against the biasing force of the spring so that the pump pressure is transmitted to the chamber of a variable displacement device so as to urge a piston mechanically connected to the variable displacement pump thereby reducing the displacement volume of the pump.

In this conventional system, there are following problems.

(1) Improvement in response to control system renders the system unstable. Such unstable condition is caused by overdisplacement of the variable displacement device.

(2) Because the displacement volume of the pump reaches its maximum when the pump is stopped, the prime mover for the pump cannot be easily started.

(3) Since the fluid pressure source for the control valve varies depending on the load applied, it becomes difficult to provide other types of displacement controls than the cut-off control.

(4) Heretofore, in case where a plurality of actuators are driven by a single variable displacement pump, the cut-off control value must be adjusted manually for each actuator in operation.

SUMMARY OF THE INVENTION

It is therefore an object of the present invention to provide a displacement control system for a variable displacement pump which is capable of overcoming the above noted problems.

Another object of the present invention is to provide a displacement control system for a variable displacement pump wherein the cut-off value for the variable displacement pump can be automatically adjusted for each actuator to be operated.

A further object of the present invention is to provide a displacement control system for a variable displacement pump wherein a stable and reliable displacement control can be achieved by reducing the over-movement of a servo piston due to inertia to a minimum.

A still further object of the present invention is to provide a displacement control system for a variable displacement pump wherein displacement volume can be kept a minumum when a charge pump is out of operation thereby improving starting-up characteristics of a prime mover for driving the variable displacement pump. In accordance with an aspect of the present invention, there is provided a displacement control system for a variable displacement pump comprising: charge pump means; first actuator means connected to said variable displacement pump; second actuator means connected to said variable displacement pump, said first and second actuator means being arranged in parallel with respect to said variable displacement pump; cut-off control valve means connected to said charge pump means, said cut-off control valve means comprising a valve body having a first and a second pump ports, a pressure port and a first outlet port formed therein, the first pump port being connected to said charge pump means, the second pump port being connected to said variable displacement pump and the pressure port being connected to said first actuator means, sleeve means mounted within said valve body, a first pin slidably mounted within said sleeve means, a second pin slidably mounted within said sleeve means, the cross-sectional area of which is larger than that of said first pin, a spool slidably mounted within said sleeve means, the cross-sectional area of which is larger than that of said second pin, a cylindrical cap member fixedly secured to said valve body defining a spring chamber therein, and spring means disposed within said spring chamber for urging said spool toward connecting said first pump port with said first outlet port; and servo booster means connected to said first outlet port for controlling the displacement of said variable displacement pump.

The servo booster means comprises servo pilot-operated spool valve means connected to said first outlet port and operated by the hydraulic fluid therefrom, said servo pilot-operated spool valve means being connected to said charge pump means, and servo cylinder means having a piston mounted therein, the piston being mechanically connected to said variable displacement pump for controlling the displacement therefrom. The rod-side chamber of said servo cylinder means is connected to the charge pump means and the head-side chamber thereof is connected to the servo pilot-operated spool valve means.

The above and other objects, features and advantages of the present invention will be readily apparent from the following description taken in conjunction with the accompanying drawings.

DETAILED DESCRIPTION OF THE INVENTION

Figure 1:
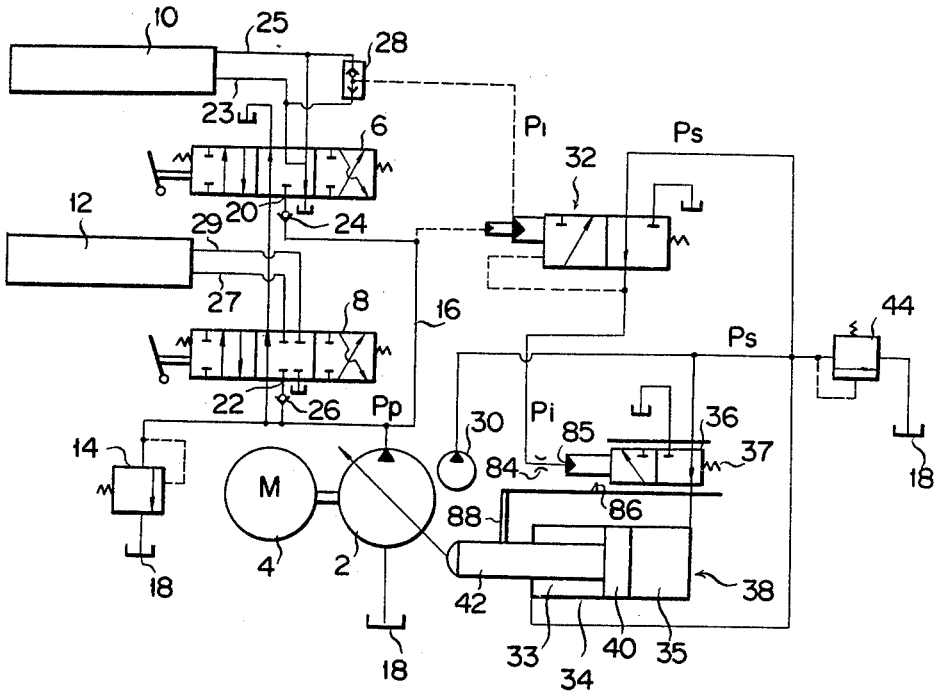
FIG. 1 is a hydraulic circuit of a displacement control system for a variable displacement pump according to the present invention.

The present invention will now be described below with reference to the accompanying drawings. Reference numeral 2 denotes a variable displacement pump driven by a prime mover 4. Connected in parallel through spring-centered three-position selector valves 6 and 8 to the delivery side of the variable displacement pump 2 are actuators 10 and 12. Also connected to the delivery side of the pump 2 is a relief valve 14 which connects a system line 16 to a tank 18 when the fluid pressure in the system line 16 exceeds the cracking pressure of the relief valve 14. Ports 20 and 22 of the selector valves 6 and 8 are connected to the delivery side of the pump 2 through check valves 24 and 26, respectively. Both lines 23, 25 from the actuator 10 are connected to the drain when the selector valve 6 is in neutral or center position while lines 27, 29 from the actuator 12 are closed when the selector valve 8 is in neutral or center position. Provided between the lines 23, 25 from the actuator 10 is a shuttle valve 28. Reference numeral 30 denotes a fixed displacement charge pump, the delivery side of which is connected to a cut-off control valve 32, a rod-side fluid chamber 33 of a servo cylinder 34 and a servo pilot-operated spool valve 36 which in turn connects with a head-side fluid chamber 35 of the servo cylinder 34. The servo cylinder 34 together with the servo pilot-operated spool valve 36 forms a servo booster 38.

A piston 40 of the servo cylinder 34 is mechanically connected to a yoke or a swash plate (not shown) of the variable displacement pump 2 through a piston rod 42. Reference numeral 44 denotes a relief valve which connects the charge pump 30 to the tank 18.

Figure 2:
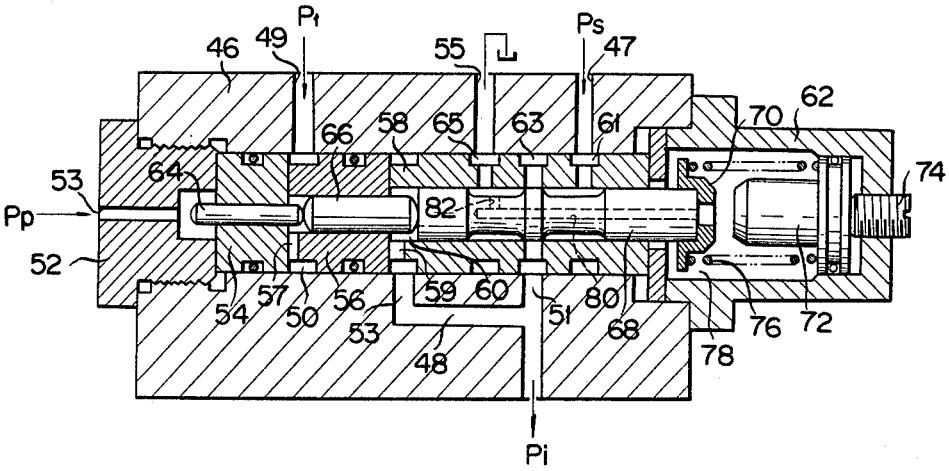
FIG. 2 is a cross-sectional view of a cut-off control valve used in the hydraulic circuit of FIG. 1.

Referring to FIG. 2, the cut-off control valve 32 has a valve body 46 having a pump port 47, a pressure port 49, outlet ports 51, 53 and a drain port 55 formed therein. The outlet port 53 communicates through a passage or feedback circuit 48 with the outlet port 51. The valve body 46 has a bore hole 50 formed therein at one end of which is fitted a plug member 52. The plug member 52 has a pump port 53 formed therein connected to the delivery side of the variable displacement pump 2.

Sleeves 54, 56 and 58 are fitted in the bore hole 50. The sleeve 56 has formed therein a passage 57 which communicates with the pressure port 49 while the sleeve 58 has formed therein a passage 59 communicating a fluid chamber 60 with the outlet port 53.

Fixedly secured to the right end of the valve body 46 is a cylindrical cap member 62. A pin 64 is slidably mounted in the sleeve 54 and a pin 66 is slidably mounted in the sleeve 56. The diameter of the pin 66 is larger than of the pin 64. Simiarly slidably mounted within the sleeve 58 is a spool 68, the diameter of which is larger than that of the pin 66. The sleeve 58 has formed therein ports 61, 63 and 65 with the port 61 being in communication with the pump ports 47, the port 63 being communicated with the outlet port 51 and the port 65 being in constant communication with the drain port 55. A spring retainer 70 is fitted to the right end of the spool 68. Movably mounted in the cylindrical cap member 62 is a piston-shaped stopper 72. The cylindrical cap member 62 is provided with an adjusting screw 74 which abuts against the stopper 72. A spring 76 extends between the spring retainer 70 and the stopper 72. A spring chamber 78 communicates with drain through a passage 80 formed in the axial direction of the spool 68 and a restriction 82.

The pump port 53 is connected to the delivery side of the variable displacement pump 2, and the pump port 47 is connected to the delivery side of the charge pump 30. The outlet port 51 communicates through a restriction 84 with an actuating port 85 of the servo pilot-operated spool valve 36.

The operation of the present invention will now be described hereinbelow.

In this embodiment, the maximum working or operating pressure $P_{2max}$ of the actuator 12 is set higher than the maximum working or operating pressure $P_{1max}$ of the actuator 10. That is, $P_{1max} < P_{2max}$. When the both selector valves 6 and 8 remain in neutral, the delivery side of the variable displacement pump 2 is connected to the tank through the selector valves 8 and 6. Therefore no cut-off control for the variable displacement pump 2 is necessary in this case, since fluid pressure in the system line 16 remains low.

When the selector valve 8 is shifted to either one of the offset positions and the selector valve 6 remians in neutral, the actuator 12 is connected to the variable displacement pump 2 and operated by the hydraulic fluid therefrom. In this case, the cut-off control by the cut-off control valve 32 is effected when the delivery pressure Pp reaches $P_{2max}$ as will be described below in detail.

When the both selector valves 6 and 8 are shifted to offset positions, the both actuators 10 and 12 are connected to the variable displacement pump 2 and operated by the hydraulic fluid therefrom. The shuttle valve 28 is adapted to pick up the higher hydraulic pressure in the lines 23 and 25 and introduces it as $P_1$ to the cut-off control valve 32. Since as mentioned hereinabove the maximum working pressure $P_{1max}$ of the Actuator 10 is set lower than that of the Actuator 12 or $P_{1max} < P_{2max}$, the cut-off control of the variable displacement pump 2 is effected when the delivery pressure from the pump 2 reaches $P_{1max}$.

The cut-off control by the combination of the cut-off control valve 32 and the servo booster 38 when only the actuator 12 is in operation will be described in detail below. In this case, the operating pressure $P_1$ for the actuator 10 to be introduced into the pressure port 49 remains zero. When the delivery pressure Pp of the variable displacement pump 2 is low, the pins 64, 66 and the spool 68 are pushed leftwards by the force of the spring 76 to allow the pump port 47 to communicate with the outlet port 51 so that the pilot pressure Pi becomes equal to the charge pressure Ps of the charge pump 30 set by the relief valve 44. In response to increase in the pilot pressure Pi, the spool of the pilot-operated spool valve 36 is urged to rightwards against the biasing force of a spring 37 and will assume its actuated or offset position. Consequently, the head-side fluid chamber 35 of the servo cylinder 34 is connected to the drain, and so the servo piston 40 is moved rightwards by the charge pressure Ps introduced into the rod-side fluid chamber 33 thereby increasing the displacement volume of the variable displacement pump 2.

Since the weight of the spool of the pilot-operated spool valve 36 is extremely light as compared with the weight of the yoke or swash plate of the variable displacement pump 2 or the weight of the servo piston 40, the movement of the spool of the pilot-operated spool valve 36 due to inertia can be extremely reduced.

With an increase in the pump delivery pressure Pp, the spool 68 is moved rightwards with the pins 64 and 66 against the biasing force of the spring 76 to cut off the communication between the ports 47 and 51 and allow communication between the port 51 and the drain port 55 thereby lowering the pilot pressure Pi. With the lowering of the pilot pressure Pi, the pilot-operated spool valve 36 is returned to its neutral position by the force of the spring 37 and will strike against a stop 86 which is fitted to a member 88 mechanically connecting the piston rod 42 and the pilot-operated spool valve 36 to move the servo piston 40 leftwards thereby reducing the displacement volume of the variable displacement pump 2.

Because the charge pressure Ps will decrease when the charge pump 30 is stopped, the communication between the ports 47 and 51 is cut off and therefore the pilot pressure Pi will decrease. Consequently, as mentioned hereinabove, the servo piston 40 is moved leftwards so that the displacement volume of the pump 2 reaches its minimum. Since the charge pressure Ps will increase when the charge pump 30 is started to be driven, the pilot pressure Pi will increase and the displacement volume of the pump 2 will reach its maximum.

One of the features of the present invention resides in that the displacement volume of the variable displacement pump 2 can be controlled by the charge pressure Ps generated by the charge pump 30 which is provided separately from the variable displacement pump 2 so that displacement controls other than the aforementioned cut-off control can be easily made.

If the control gain of the cut-off control valve 32 is increased in order to increase the response characteristic of the displacement control for the pump 2, the pilot pressure Pi tends to become excessively overshoot and unstable so that hunting of the variable displacement pump 2 may occur. In order to prevent an excessive overshoot of the pilot pressure Pi, the feedback circuit 48 is provided to introduce the pilot pressure Pi into the chamber 60 through the passage 59. Since the diameter of the spool 68 is larger than that of the pin 66, when the pilot pressure Pi becomes excessively high the spool 68 is moved rightwards against the biasing force of the spring 76 to cut off the communication between the ports 47 and 51 and allow the port 51 to communicate with the drain port 55. As a result, the pilot pressure Pi is released into the drain and the generation of excessive pressure overshoot and hunting can be avoided.

In case where the both actuators 10 and 12 are operated, the operating pressure $P_1$ for the actuator 10 becomes equal to the delivery pressure Pp of the pump 2 and therefore hydraulic fluid having pressure Pp is introduced into the pressure port 49 as well as the pump port 53. Therefore when the delivery pressure Pp reaches $P_{1max}$, the cut-off control by the combination of the cut-off control valve 32 and the servo booster 38 as described hereinabove is effected. $P_{1max}$ is determined by the diameter of the pin 66 and in order to maintain the relation of $P_{1max} < P_{2max}$, the diameter of the pin 66 must be larger than that of the pin 64.

Figure 3:
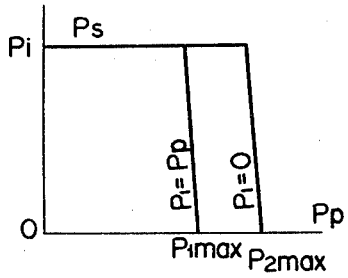
FIG. 3 is a diagram showing characteristic features of a cut-off control valve wherein Pp is the output pressure of a variable displacement pump, Pi is the output pressure of the cut-off control valve, $P_{1max}$ is the maximum operating pressure of a first actuator and $P_{2max}$ is the maximum operating pressure of a second actuator.
Figure 4:
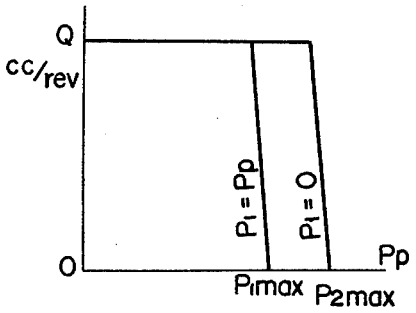
FIG. 4 is a diagram explaining how the cut-off control is effected according to the present invention wherein Q is the displacement volume of the variable displacement pump.

Referring to FIG. 3, the characteristic feature of the cut-off control valve will be readily understood. When the operating pressure $P_1$ for the actuator 10 is zero, the pilot pressure Pi remains equal to the charge pressure Ps until the delivery pressure Pp of the variable displacement pump 2 reaches the maximum operating pressure $P_{2max}$ for the actuator 12 when the pilot pressure Pi is suddenly reduced to zero. In case where the both actuators 10 and 12 are operated, the charge pressure Ps is cut-off and the pilot pressure Pi is suddenly reduced to zero when the delivery pressure Pp of the pump 2 reaches the maximum operating pressure $P_{1max}$ for the actuator 10. FIG. 4 shows the cut-off displacement control of the variable displacement pump 2. In case where only the actuator 12 is operated, the cut-off control is effected and displacement volume becomes zero when the delivery pressure Pp of the pump 2 reaches $P_{2max}$. In case where the both actuators 10 and 12 are operated, the displacement volume becomes zero when the delivery pressure Pp reaches $P_{1max}$ which is lower than $P_{2max}$.

It is clear from the foregoing that the invention is well calculated to fulfill the objects set forth herein. Since, however, numerous modifications or changes of the invention will be readily conceived to those skilled in the art on the basis of this disclosure, it is intended that all matter described herein and shown in the accompanying drawings shall be interpreted as illustrative and not in a limiting sense.

What we claim is:

1. A displacement control system for a variable displacement pump comprising:

charge pump means;

first actuator means connected to said variable displacement pump;

second actuator means connected to said variable displacement pump, said first and second actuator means being arranged in parallel with respect to said variable displacement pump;

cut-off control valve means connected to said charge pump means, said cut-off control valve means comprising a valve body having a first and a second pump ports, a pressure port and a first outlet port formed therein, the first pump port being connected to said charge pump means, the second pump port being connected to said variable displacement pump and the pressure port being connected to said first actuator means, sleeve means mounted within said valve body, a first pin slidably mounted within said sleeve means, a second pin slidably mounted within said sleeve means, the cross-sectional area of which is larger than that of said first pin, a spool slidably mounted within said sleeve means, the cross-sectional area of which is larger than that of said second pin, a cylindrical cap member fixedly secured to said valve body defining a spring chamber therein, and spring means disposed within said spring chamber for urging said spool toward connecting said first pump port with said first outlet port; and servo booster means connected to said first outlet port for controlling the displacement of said variable displacement pump.

2. A displacement control system for a variable displacement pump as defined in claim 1 wherein said servo booster means comprises servo pilot-operated spool valve means connected with said first outlet port and operated by the hydraulic pressure therefrom, said servo pilot-operated spool valve means being connected to said charge pump means, and servo cylinder means having a piston mounted therein, a rod-side chamber and a head-side chamber, the piston being mechanically connected to said variable displacement pump for controlling the displacement thereform, said rod-side chamber of said servo cylinder means being connected to said charge pump means and said head-side chamber thereof being connected to said servo pilot-operated spool valve means.

3. A displacement control system for a variable displacement pump as defined in claim 1 wherein said valve body has a second outlet port communicated with a chamber formed by said sleeve means, said second pin and one end of said spool, and a passage formed therein communicating said first outlet port with said second outlet port.

4. A displacement control system for a variable displacement pump as defined in claim 1, 2 or 3 wherein said first actuator means is connected with the pressure port of said cut-off control valve means through shuttle valve means.

* * * * *